US006378431B1

(12) United States Patent
Detmers

(10) Patent No.: US 6,378,431 B1
(45) Date of Patent: Apr. 30, 2002

(54) PRINTING MACHINE HAVING A PLURALITY OF PRINTING UNITS FOR OVERPRINTING A PLURALITY OF INKS IN ONE PASS

(75) Inventor: Andreas Detmers, Mauer (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/484,797

(22) Filed: Jan. 18, 2000

(30) Foreign Application Priority Data

Jan. 18, 1999 (DE) ..... 199 01 701

(51) Int. Cl.[7] ..... B41M 1/14; B41M 1/18; B41N 3/00; B41C 1/10

(52) U.S. Cl. ..... 101/463.1; 101/183; 101/217

(58) Field of Search ..... 101/465, 467, 101/463.1, 183, 217

(56) References Cited

U.S. PATENT DOCUMENTS 5,237,923 A * 8/1993 Williams et al. ..... 101/467
5,405,723 A * 4/1995 Rhodes et al. ..... 430/49
5,887,525 A * 3/1999 Okamura et al. ..... 101/463.1
5,983,793 A * 11/1999 Volz et al. ..... 101/216
6,029,576 A 2/2000 Fischer et al. ..... 101/485
6,079,331 A * 6/2000 Koguchi et al. ..... 101/467
6,101,944 A * 8/2000 Schmid et al. ..... 101/467
6,161,480 A * 12/2000 Pfizenmaier ..... 101/467

FOREIGN PATENT DOCUMENTS

DE 195 33 810 A1 3/1997
DE 195 33 811 A1 3/1997
GB 2323177 A * 9/1998

* cited by examiner

*Primary Examiner*—Daniel J. Colilla
(74) *Attorney, Agent, or Firm*—Herbert L. Lerner; Laurence A. Greenberg; Werner H. Stemer

(57) ABSTRACT

A printing machine having a plurality of printing units for overprinting a plurality of inks in one pass, including a device for producing a printing form in each of the printing units, equipment for feeding to the device data for reproducing a printing image, and a tool responsive to the data for producing image points for accepting printing ink; a device for inking the printing forms and for transferring printing ink onto a printing material; and at least one computer for controlling imaging on the printing forms and for controlling the printing process, includes a first memory for storing data for a first printing image that is produced from overprinting a plurality of printing inks, the plurality of printing inks being at least equal to the plurality of printing units; a second memory for storing data for a second printing image that is produced from printing with a plurality of printing inks that is at most equal to a difference between the plurality of printing units and the plurality of printing inks used for printing first printing image; and a computer for effecting substantially simultaneous imaging on the printing forms for the first and the second printing images.

4 Claims, 1 Drawing Sheet

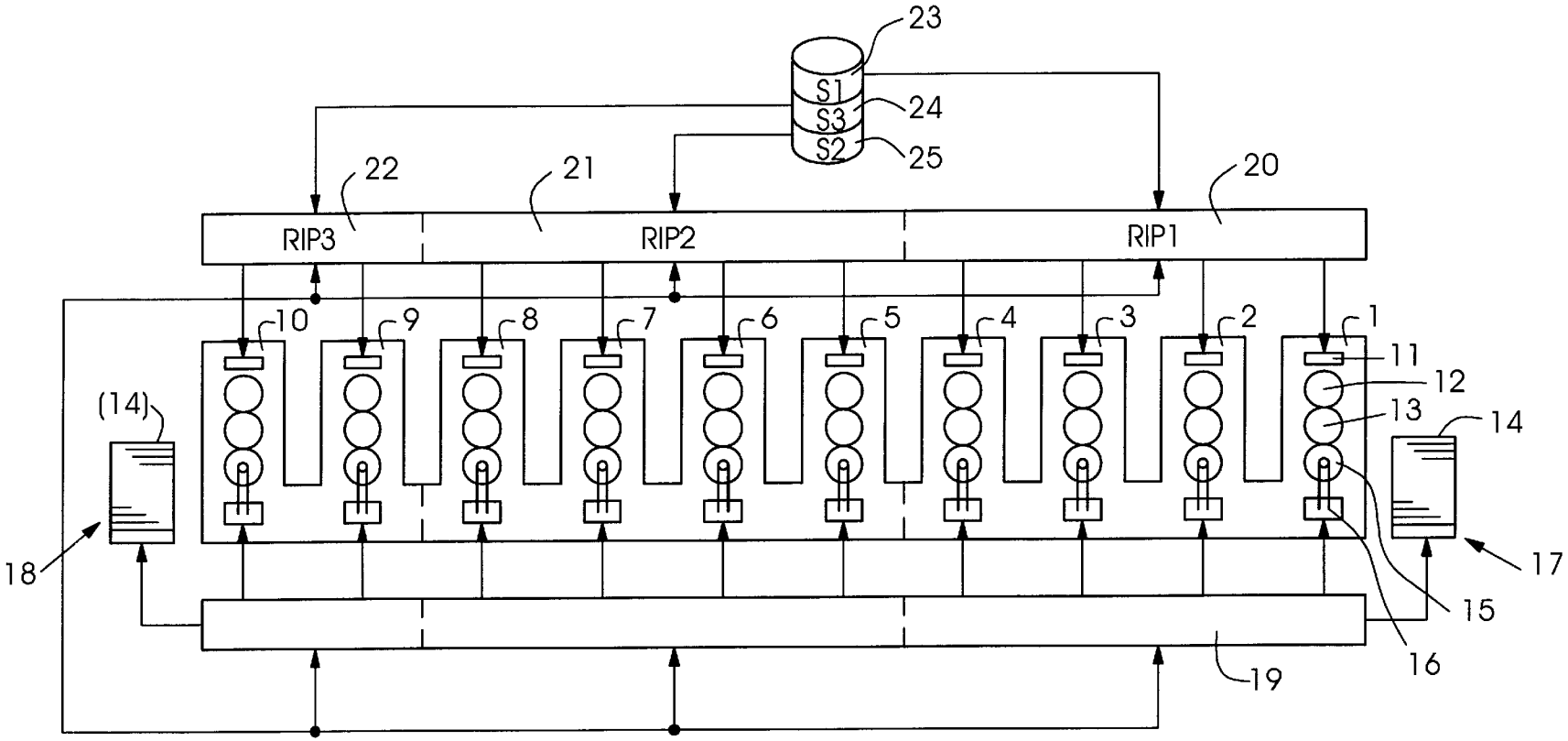
RIP1
RIP2
RIP3
S1
S3
S2
1
2
3
4
5
6
7
8
9
10
11
12
13
14
15
16
17
18
19
20
21
22
23
24
25
(14)

PRINTING MACHINE HAVING A PLURALITY OF PRINTING UNITS FOR OVERPRINTING A PLURALITY OF INKS IN ONE PASS

BACKGROUND OF THE INVENTION

FIELD OF THE INVENTION

The invention relates to a printing machine having a plurality of printing units for overprinting a plurality of inks on webs or sheets in one pass.

In modern printing plants, devices for producing printing forms, such as printing plates, and printing machines are provided in one machine room. Short transport paths between a device for producing printing forms or plates, and the various printing machines is intended to shorten the make-ready or set-up time of the printing machines. In printing plants with separate devices for producing printing forms or plates, it is necessary to mount the printing forms or plates belonging to a printing image in the printing units of a selected printing machine, and to position them in order to adjust the register. The printing forms or plates are brought into register during printing, this operation lasting a given length of time, and a number of misprints being produced during that time period.

In order to reduce the make-ready or set-up time further, printing machines are employed into which the device for producing the printing forms or plates is already integrated. Transport times from separate devices for producing printing forms or plates are thereby dispensed with, and the time for bringing the printing forms or plates into register is reduced, because the imaging has already been performed approximately in-register. Such a printing machine has been described heretofore in the published German Patent Application DE 197 43 770.2. The invention described in that document offers the possibility that, during printing with a printing machine, printing forms or plates for another print job are produced in the same printing machine. The object of the invention in the foregoing document is to increase the use of a previously existing raster image processor, and the connected imaging tools. The raster image processor data can be fed to selected imaging tools. Simultaneous printing and imaging is problematic, because the printing process can exert undesired influences upon the imaging.

SUMMARY OF THE INVENTION

It is accordingly an object of the invention of the instant application to provide a printing machine of the foregoing general type with improved efficiency and improved imaging quality.

With the foregoing and other objects in view, there is provided, in accordance with the invention, a printing machine having a plurality of printing units for overprinting a plurality of inks in one pass, including a device for producing a printing form in each of the printing units, equipment for feeding to the device data for reproducing a printing image, and a tool responsive to the data for producing image points for accepting printing ink; a device for inking the printing forms and for transferring printing ink onto a printing material; and at least one computer for controlling imaging on the printing forms and for controlling the printing process, comprising a first memory for storing data for a first printing image that is produced from overprinting a plurality of printing inks, the plurality of printing inks being at least equal to the plurality of printing units; a second memory for storing data for a second printing image that is produced from printing with a plurality of printing inks that is at most equal to a difference between the plurality of printing units and the plurality of printing inks used for printing the first printing image; and a computer for effecting substantially simultaneous imaging on the printing forms for the first and the second printing images.

In accordance with another feature of the invention, the printing machine includes respective raster image processors for producing the printing forms for the first and the second printing images, respectively.

In accordance with a further feature of the invention, the printing machine includes a computer having a multitasking capability for producing the printing forms for the first and the second printing images.

In accordance with an added feature of the invention, the printing machine includes devices in each printing unit for removing the printing forms, those printing units having the printing forms of one of the images being operable together.

In accordance with a concomitant feature of the invention, the printing forms belonging to one printing image are removable from the printing machine while printing is being performed with the printing forms belonging to another printing image.

The invention permits simultaneous production of printing forms of two or even more printing images in one and the same printing machine. Printing forms belonging to one print job remain in a printing machine in order to process an existing print job. The printing forms belonging to a further print job or to a number of further print jobs are removed from the printing machine and are used for printing the further print jobs on the same printing machine or other printing machines.

The removal of the printing forms can be performed during printing. It is possible to produce a set of printing forms for a further print job in two or more partial steps. For example, in the case of a 6-color printing machine, in a first partial step, a set of printing forms for 4-color printing and a half set of printing forms for a 4-color print of a further printing machine are produced, and in a second partial step, a further set of printing plates for 4-color printing and the second half set of printing plates for the 4-color print on the further printing machine are completed. If the disposition of print jobs in a printing plant results in the situation wherein no current print job is to run on a printing machine according to the invention, then the printing machine can be used as an apparatus purely for producing printing forms. The outlay for implementing a printing machine according to the invention is low, because additional raster image processors or the multitasking capability of a computer necessitate only low additional costs. The control of the chronological sequence of the imaging of various printing images on printing forms can be performed in a manner that the imaging of all the printing forms is completed at virtually the same time. The input variable used for the chronological course or sequence of the imaging can be the number of image points to be set for the printing form or the area coverage values of the printing forms. By using such a printing machine, assurance is offered that the imaging device has virtually no idle time. The use of printing machines in a printing plant is improved.

Other features which are considered as characteristic for the invention are set forth in the appended claims.

Although the invention is illustrated and described herein as embodied in a printing machine having a plurality of printing units for overprinting a plurality of inks in one pass, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, wherein:

BRIEF DESCRIPTION OF THE DRAWINGS

The single figure is a schematic diagram of a printing machine having ten printing units incorporating the invention of the instant application.

DESCRIPTION OF THE PREFERRED EMBODIMENTS

Referring now to the single figure of the drawing, there are shown therein ten printing units 1 to 10, each of which includes a device 11 for producing a printing form, such as a printing plate. The respective printing form or plate is disposed on a printing form or plate cylinder 12. When an image is formed on a printing form or plate, the printing form or plate cylinder 12 is thrown off an associated transfer cylinder 13. During the printing operation, the printing form or plate cylinder 12 is thrown onto the transfer cylinder 13, the printing form or plate being inked in accordance with a printing image, and the printing ink being transferred from the printing form or plate cylinder 12, via the transfer cylinder 13, onto a sheet 14. The sheet 14 passes through a printing nip between the transfer cylinder 13 and an impression cylinder 15. The impression cylinder 15 is driven in synchronism with the transfer cylinder 13 and the printing plate cylinder 12 by a motor 16. All of the non-illustrated actuators and/or sensors of the printing units 1 to 10, a device 17 for sheet feeding and a device 18 for sheet delivery are connected to a multifunctional control system 19. The respective printing form or plate producing devices 11 of the printing units 1 to 4 have a raster image processor 20 assigned thereto, the devices 11 of the printing units 5 to 8 have a raster image processor 21 assigned thereto, and the device 11 of the printing units 9 to 10 have a raster image processor 22 assigned thereto. Each raster image processor 20 to 22 has a respective memory 23, 24 and 25 assigned thereto for data reproducing a printing image. The raster image processors 20 to 22 are likewise connected to the control system 19.

The mode of operation of the printing machine is described hereinafter. The printing machine is one of many printing machines operating in a printing plant. According to the disposition of the machines, it is envisaged that, as the next print job, a number of prints is to be produced which carry a 4-color first printing image that is loaded in the memory 23. Furthermore, a print job for a second 4-color printing image is waiting its turn, the image data therefor being located in the memory 25, as well as a print job for a 2-color image corresponding to the image data being provided in the memory 24. The image data in the memories 23, 24 and 25 are transmitted substantially simultaneously to the raster image processors 20 to 22. The raster image processors 20 to 22 use the image data to produce imaging data for activating the device 11 in accordance with the colors to be printed in the respective printing unit 1 to 10. After the end of the imaging on the printing forms or plates, the printing forms or plates are removed from the printing units 5 to 10. The printing forms or plates can be removed while the print job with the first printing image is being processed by the printing units 1 to 4. The printing machine is specifically constructed for the removal of printing forms or plates during the printing operation. In order to process the print job using the printing image in the memory 25, the printing forms or plates removed from the printing units 5 to 8 are accepted into a further 4-color printing machine. The printing forms or plates from the printing units 9 and 10 are used to equip a 2-color printing machine, where the print job runs with the printing image in the memory 24. The control system 19 effects the synchronization of the rotation of the printing form or plate cylinders 12 based upon the imaging data fed to the respective device 11. The control system 19 is constructed so that the imaging operating processes to be controlled for the operation of the printing units 1 to 4, 5 to 8 and 9 to 10 for the imaging can proceed independently of one another.

The number of devices 11 for producing printing forms or plates to be driven by the raster image processors 20, 21 and 22 can be changed as required. For example, the raster image processor 20 can form an image for a job for a 6-color print in the printing units 1 to 6, while in the printing units 7 and 8, on the one hand, and 9 and 10, on the other hand, in each case, printing forms or plates for a 2-color print job are having images formed or set by the raster image processors 21 and 22. The mode of operation of the control system 19 and the organization of the number and size of the memories 23, 24 and 25 are, in each case, matched to the print job resulting from the disposition.

In the case of printing machines which are suitable to operate optionally with conventional pre-imaging printing films or plates, or with printing forms or plates to be formed or set with images in the printing machine, it would be possible, during the mounting of conventional printing films, foils or plates on part of the printing forms 12, to set or form images on printing forms or plates on the other printing form or plate cylinders 12 by the device 11 belonging to the machine.

I claim:

1. A printing machine having a plurality of printing units for overprinting a plurality of inks in one pass, including a device for producing a printing form in each of the printing units, equipment for feeding data to the device for reproducing a printing image, and a tool responsive to the data for producing image points for accepting printing ink;

a device for inking the printing forms and for transferring printing ink onto a printing material; and at least one computer for controlling imaging on the printing forms and for controlling the printing process, comprising a first memory for storing data for a first printing image that is produced from overprinting a plurality of printing inks, the plurality of printing inks being at least equal to the plurality of printing units; a second memory for storing data for a second printing image that is produced from printing with a plurality of printing inks that is at most equal to a difference between the plurality of printing units and the plurality of printing inks used for printing said first printing image; and a computer for effecting substantially simultaneous imaging on the printing forms for said first and said second printing images, said computer controlling said first memory, said second memory and said device for producing the printing form in each of the printing units such that the first printing image forms an image of a first print job and the second image forms an image of a second print job.

2. The printing machine according to claim 1, including a respective raster image processor for producing the printing forms for the first and the second printing images, respectively.

3. The printing machine according to claim 1, wherein said computer has a multitasking capability for producing the printing forms for the first and the second printing images.

4. The printing machine according to claim 1, wherein the printing units having the printing forms of one of the images are operable together.

* * * * *